US008408192B2

(12) United States Patent
McPherson

(10) Patent No.: US 8,408,192 B2
(45) Date of Patent: Apr. 2, 2013

(54) LIMB MOUNTING SYSTEM

(75) Inventor: Mathew A. McPherson, Norwalk, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 13/284,615

(22) Filed: Oct. 28, 2011

(65) Prior Publication Data

US 2012/0042864 A1 Feb. 23, 2012

Related U.S. Application Data

(63) Continuation of application No. 11/941,918, filed on Nov. 16, 2007, now Pat. No. 8,047,189.

(60) Provisional application No. 60/859,395, filed on Nov. 16, 2006.

(51) Int. Cl.
*F41B 5/00* (2006.01)

(52) U.S. Cl. ..... 124/23.1

(58) Field of Classification Search ..... 124/23.1, 124/25.6, 86, 88
See application file for complete search history.

(56) References Cited

U.S. PATENT DOCUMENTS

| | | | |
|---|---|---|---|
| 480,879 | A | 8/1892 | Stevenson |
| RE13,844 | E | 12/1914 | Sawyer |
| 1,371,619 | A | 3/1921 | Greenstreet |
| 4,261,320 | A | 4/1981 | Barna |
| 4,644,929 | A | 2/1987 | Peck |
| 5,231,970 | A | 8/1993 | Ploot et al. |
| 5,280,779 | A | 1/1994 | Smith |
| 5,339,790 | A | 8/1994 | Smith |
| 5,368,006 | A | 11/1994 | McPherson |
| 5,408,982 | A | 4/1995 | Doornenbal |
| 5,429,106 | A | 7/1995 | Martin et al. |
| 5,433,792 | A | 7/1995 | Darlington |
| 5,464,001 | A | 11/1995 | Peck |
| 5,487,373 | A | 1/1996 | Smith |
| 5,507,270 | A | 4/1996 | Smith |
| 5,515,836 | A | 5/1996 | Martin et al. |
| 5,592,929 | A | 1/1997 | Hoyt, Jr. |
| 5,660,158 | A | 8/1997 | Rudolph |
| 5,720,267 | A | 2/1998 | Walk |
| 5,722,380 | A | 3/1998 | Land et al. |
| 5,947,099 | A | 9/1999 | Derus |
| 6,024,076 | A | 2/2000 | Laborde et al. |
| 6,244,259 | B1 | 6/2001 | Adkins |
| 6,257,220 | B1 | 7/2001 | McPherson et al. |
| 6,267,108 | B1 | 7/2001 | McPherson et al. |
| 6,360,734 | B1 | 3/2002 | Andrews |
| 6,371,098 | B1 | 4/2002 | Winther |
| 6,571,785 | B1 | 6/2003 | Choma |
| 6,712,057 | B2 | 3/2004 | Andrews |
| 6,786,214 | B2 | 9/2004 | Andrews |
| 6,886,549 | B2 | 5/2005 | McPherson |
| 6,941,937 | B2 | 9/2005 | Wheeler |
| 6,964,271 | B2 | 11/2005 | Andrews |

(Continued)

OTHER PUBLICATIONS

U.S. Appl. No. 12/916261, filed Oct. 29, 2010; Inventor: McPherson.
Jennings Archery, Advertisement, FNT(TM) Limbs, Date Unknown.

*Primary Examiner* — John Ricci
(74) *Attorney, Agent, or Firm* — Vidas, Arrett & Steinkraus

(57) ABSTRACT

An apparatus and method for reducing stress in a bow limb of an archery bow connected to a handle/riser of the bow by allowing a butt end of the bow limb connected to a forward end of the handle/riser by a limb bolt to flex forwardly when the bow is drawn and/or allowing the bow to flex rearwardly at the rearward end of the handle/riser when the bow is drawn.

21 Claims, 8 Drawing Sheets

U.S. PATENT DOCUMENTS

| | | | | |
|---|---|---|---|---|
| 7,025,051 | B1 | 4/2006 | Gallops, Jr. | |
| 7,077,116 | B1 | 7/2006 | Darlington | |
| 7,308,890 | B1 | 12/2007 | Wheeler | |
| 7,334,575 | B2 | 2/2008 | McPherson | |
| 8,047,189 | B2 * | 11/2011 | McPherson | 124/23.1 |
| 2004/0077440 | A1 | 4/2004 | Kronfeld | |
| 2004/0112355 | A1 | 6/2004 | McPherson | |

* cited by examiner

LIMB MOUNTING SYSTEM

CROSS-REFERENCE TO RELATED INVENTIONS

This application is a Continuation of U.S. patent application Ser. No. 11/94,918 filed, Nov. 16, 2007, which claims the benefit of U.S. Provisional Application No. 60/859,395, filed Nov. 16, 2006, the entire disclosures of which are hereby incorporated herein by reference.

BACKGROUND OF THE INVENTION

1. Field of the Invention

This invention relates to archery bows. More particularly, this invention relates to an apparatus and method for mounting a bow limb to the riser of a bow handle.

2. Description of the Background Art

Presently there exist many different ways for mounting the upper and lower bow limbs of a compound bow to the upper and lower ends of a riser of the bow handle. Most commonly, the butt of each bow limb is positioned into a rectilinear limb pocket aligned contiguous with the outer planar surface of the bow handle riser. The butt of the limb is then affixed to the riser by a limb bolt inserted through a hole in the butt of the bow limb, through a corresponding hole in the limb pocket and then threaded into a threaded hole in the forward most end of the outer planar surface of the riser. During drawing of the bow, the bow limb pivots against the rearward edge of the limb pocket. Typically, the draw weight of the bow may be slightly reduced by unthreading the limb bolt a slight distance to decrease the distance between the tips of the upper and lower bow limbs.

Unfortunately, the pivoting of the limb against the rearward edge of the limb pocket during drawing of the bow, imparts great stress to the bow limb at the pivot point. Premature failure of the bow limb therefore often occurs at such pivot point.

Further, it is noted that the "middle" portion of the bow limb between such pivot point and the limb bolt seeks to bow outwardly during the drawing of the bow.

However, the limb bolt precludes the forward most butt of the bow limb from flexing to follow the natural outward flexing of the middle portion of the bow limb between such pivot point and the limb bolt. Hence, considerable stress is imparted to the forward most butt of the bow limb due to the fact that limb bolt rigidly secures the butt of the bow limb to the riser.

Therefore, it is an object of this invention to provide an improvement which overcomes the aforementioned inadequacies of the prior art devices and provides an improvement which is a significant contribution to the advancement of the archery art.

Another object of this invention is to provide a limb mounting system for a compound bow that reduces the stress imparted to a bow limb that pivots against the rearward edge of the handle riser drawing of the bow.

Another object of this invention is to provide a limb mounting system for a compound bow that includes a pivotable bow limb fulcrum at the rearward edge of the handle riser during drawing of the bow.

Another object of this invention is to provide a positive positioning system for connecting a bow limb to a handle riser that allows the forward most butt of the bow limb to flex and follow the natural outward flexing of the middle portion of the bow limb between such pivot point and the limb bolt during drawing of the bow.

Another object of this invention is to provide a positive mounting system for connecting the butt of a bow limb to a handle riser including complementary limb bolt head, swivel washer and limb cap that allow the butt of the bow limb to swivel during the drawing of the bow.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

For the purpose of summarizing the invention, the invention comprises a limb mounting system including (1) a bow limb positive positioning system and (2) a bow limb fulcrum system.

The bow limb positive positioning system of the invention connects a bow limb to a handle riser while allowing the forward most butt of the bow limb to flex and follow the natural outward flexing of the middle portion of the bow limb between such pivot point and the limb bolt during drawing of the bow when the bow is drawn. The positive mounting system comprises complementary limb bolt head, swivel washer and limb cap that allow the butt of the bow limb to swivel during the drawing of the bow to allow the butt to follow the natural outward flexing of the middle portion of the bow limb between such pivot point and the limb bolt during drawing of the bow, thereby reducing the stress that would otherwise be imparted to the butt during drawing of the bow.

The bow limb fulcrum system of the invention is positioned at the rearward edge of the handle riser to reduce the stress imparted to a bow limb that pivots against the rearward edge of the handle riser during drawing of the bow.

The functionality of the bow limb positive positioning system and the bow limb fulcrum system of the limb mounting system of the invention work alone and in unison to significantly reduce the stresses that are imparted to the forward portion of the bow limb when the bow is at rest (when undrawn) as well as when drawn.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
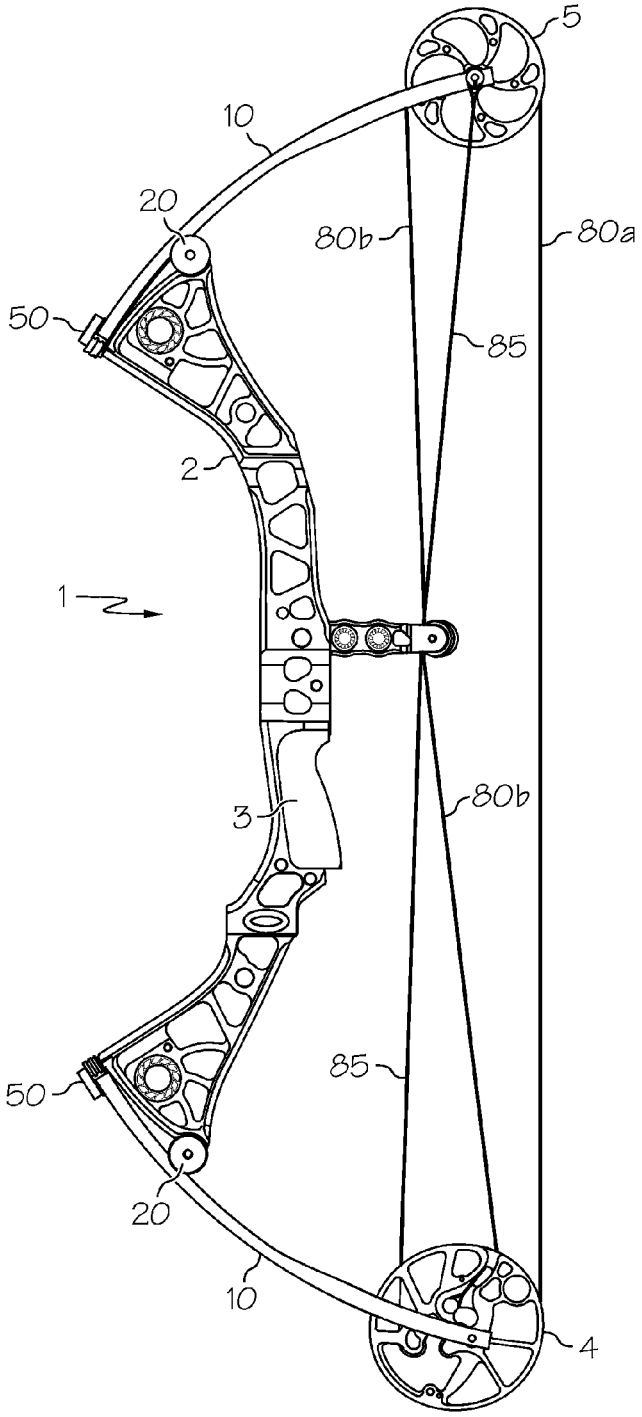
FIG. 1 is a side elevation of a single cam bow.
Figure 2:
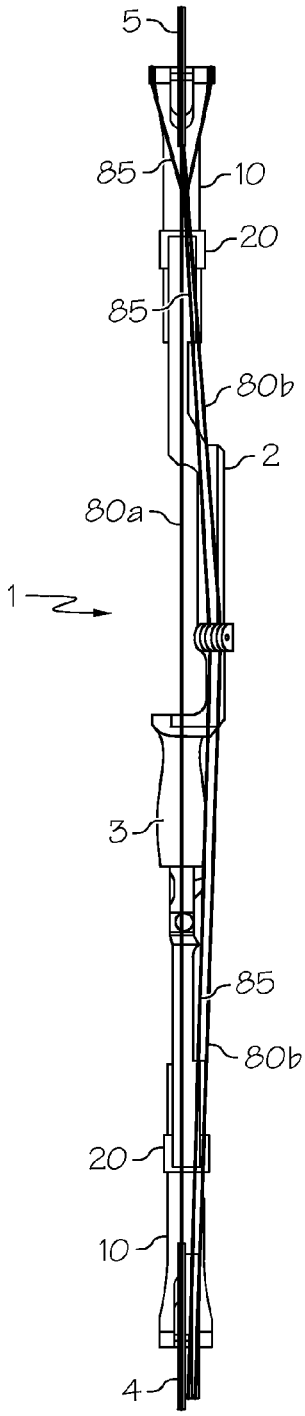
FIG. 2 is a rear elevation of the bow from the shooter's perspective.
Figure 3:
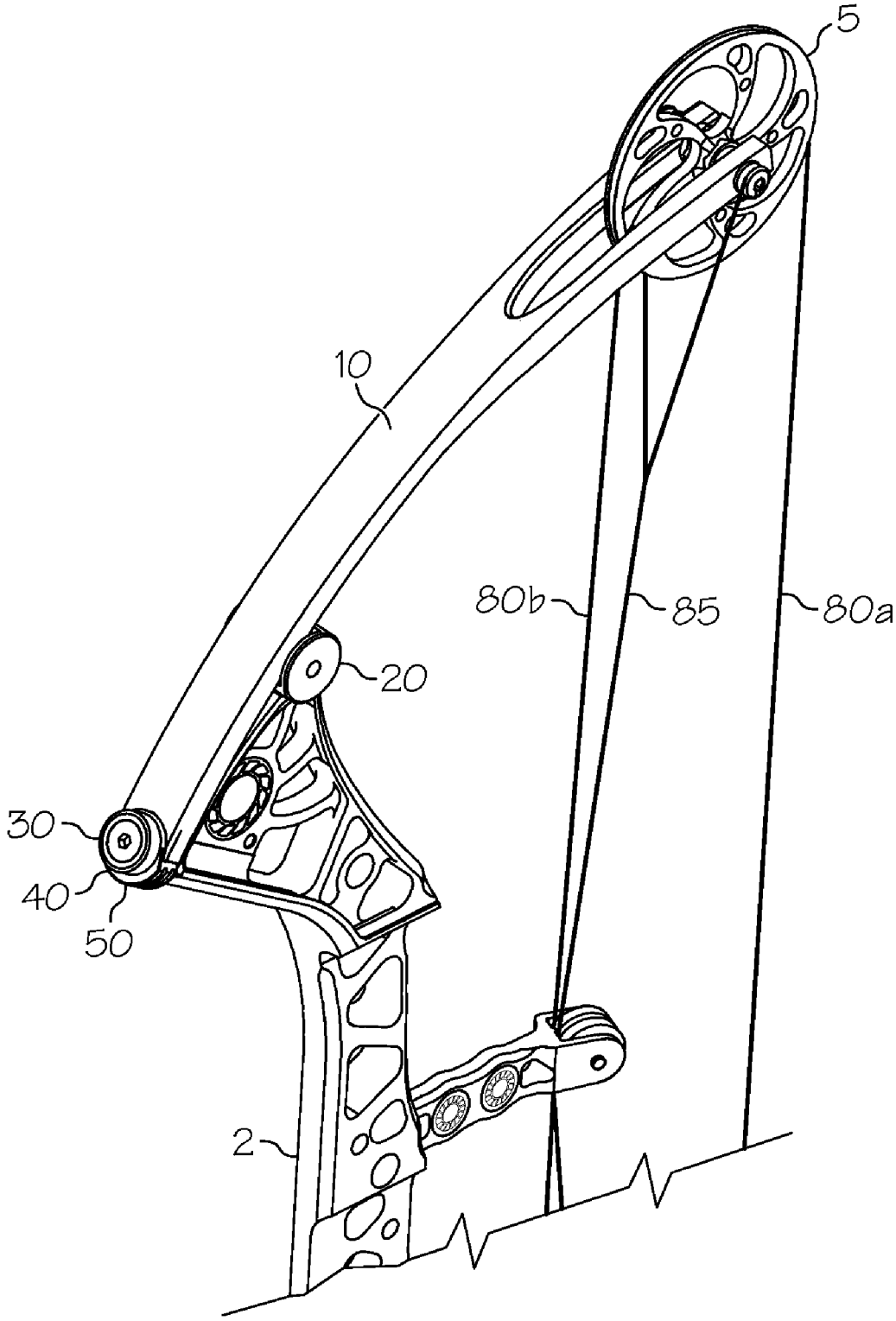
FIG. 3 is a ¾ view of the upper half of the bow.

FIG. 1 shows the general configuration of a compound bow 1 with the handle/riser 2 and grip 3. The handle/riser 2 is connected to the bow limbs 10 by the limb mounting system of the invention including a limb cap 50 and a limb fulcrum 20. At the outer end of the limbs 10 is the compounding system comprising a dual feed out single take up cam 4 mounted on the bottom limb 10 and the idler wheel 5 on the top limb 10. These two components are interconnected by the harness system comprising the bowstring 80*a* and secondary payout 80*b* and the power cable 85. Without departing from the spirit and scope of this invention, the present invention may be applied to other bow configurations such as dual cam bows, cam and a half bows etc.

Figure 4:
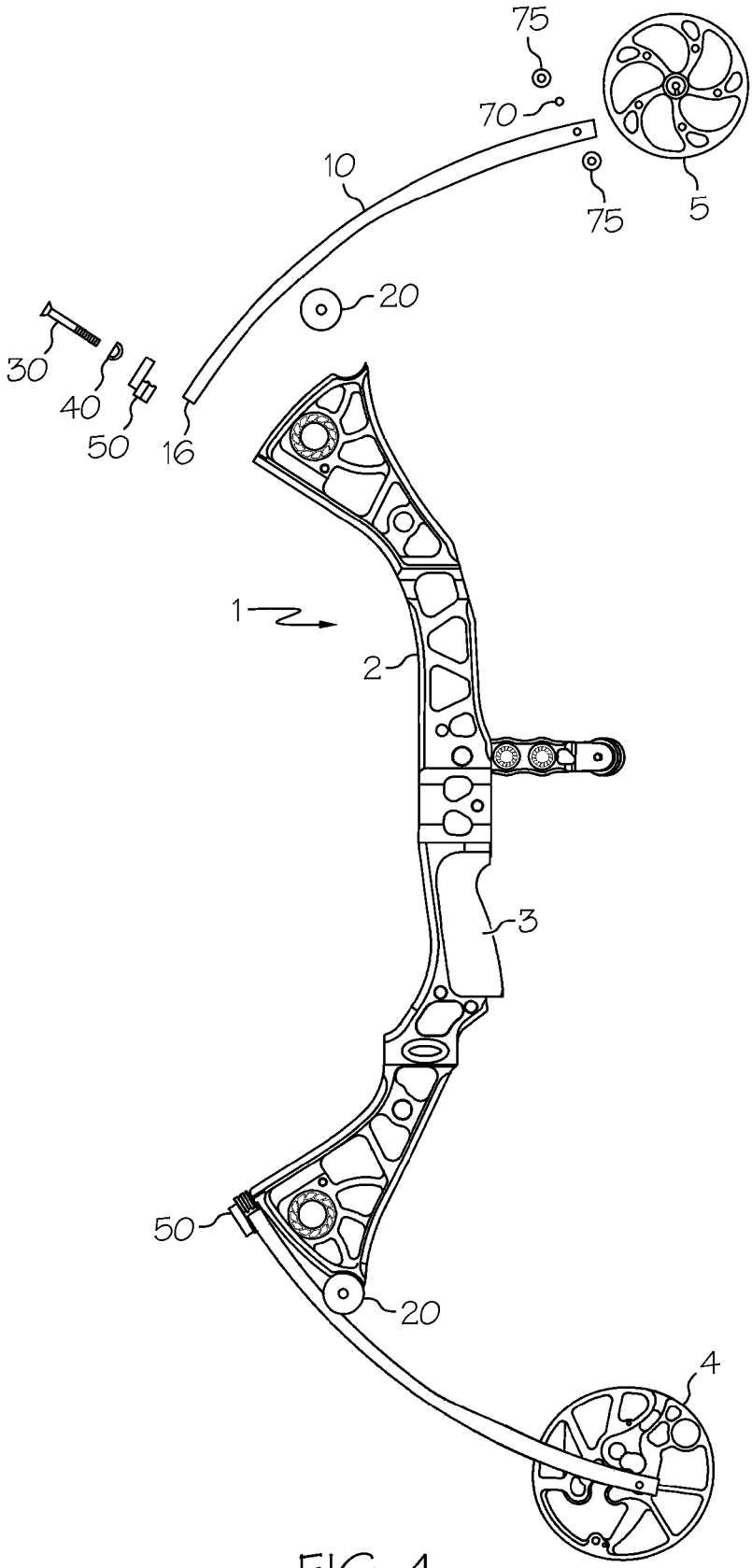
FIG. 4 is a side elevation of the bow with the various components of the upper limb mounting system exploded for identification.
Figure 5:
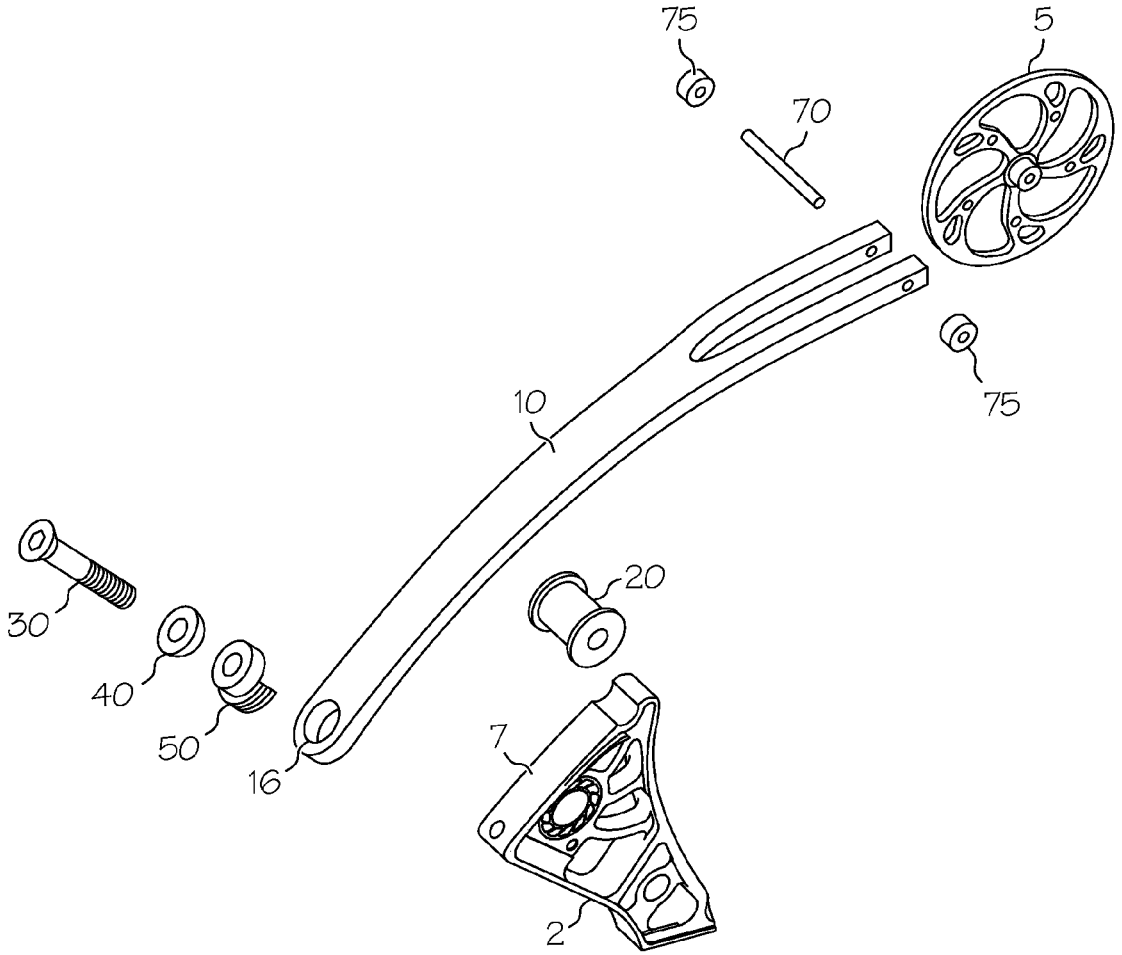
FIG. 5 is a ¾ exploded view of the limb mounting system.

The bow limb positive positioning system of the bow limb mounting system of the present invention, as shown in general in FIG. 4 and FIG. 5, comprises a limb bolt 30 positioned in a snug fit into a swivel washer 40 which in turn spherically fit into the top of the limb cap 50 and the limb cap 50 is a locational fit to the limb but 18. The butt end 18 of the limb 10 is fastened to the handle 2 with the lower surface 13 of the limb resting in limb fulcrum 20 and the limb fulcrum 20 in turn is pivotally located at the rearward end of the handle/riser 2.

Figure 6:
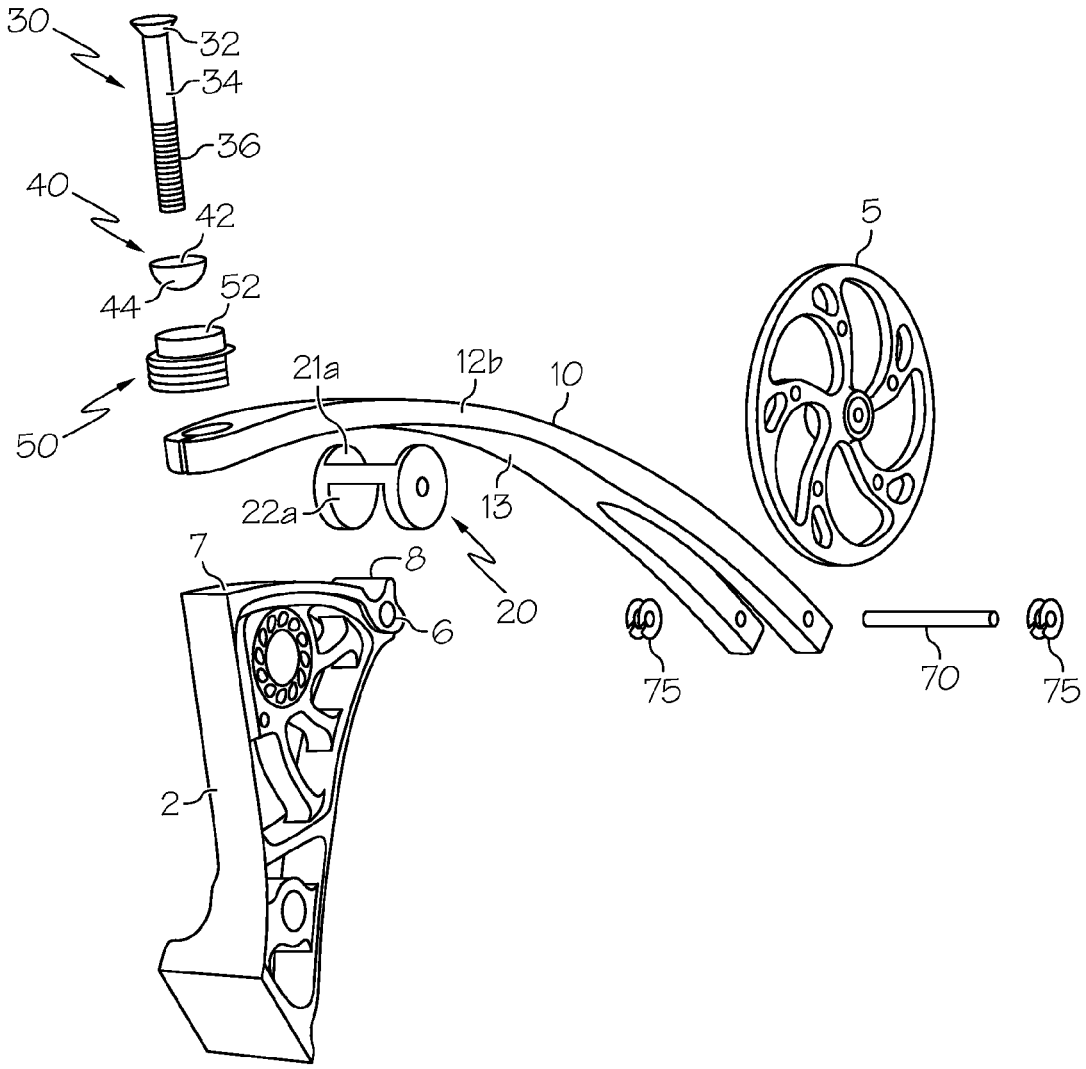
FIG. 6 is an enlarged ¾ exploded view of the components of the limb mounting system.
Figure 7:
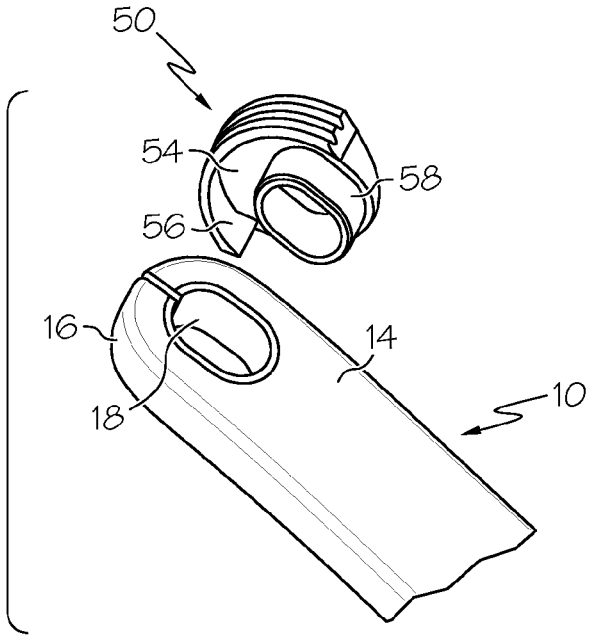
FIG. 7 is an enlarged ¾ view of the butt end of the bow limb and the limb cap.
Figure 10A:
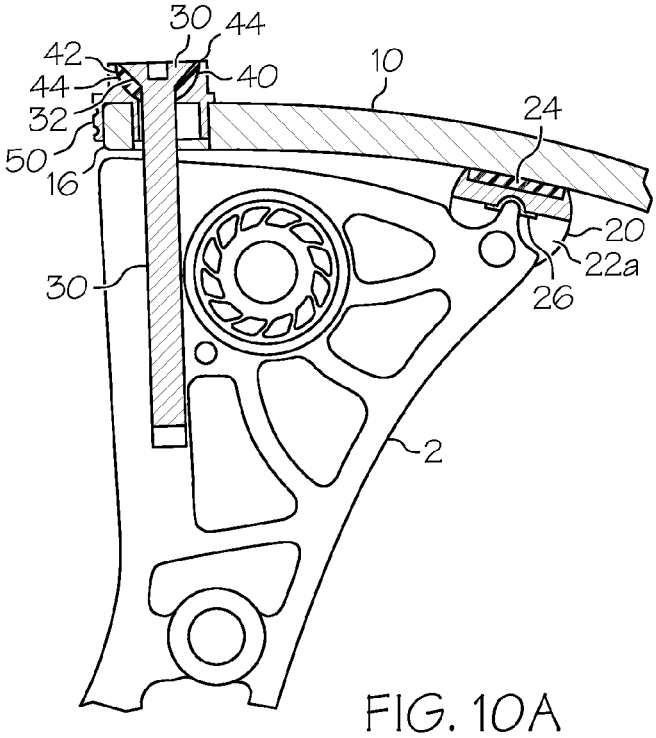
FIGS. 10A and 10B are a partial longitudinal cross-sectional views of the limb showing the cross-section of the limb mounting system when the bow is in undrawn and drawn states, respectively.
Figure 10B:
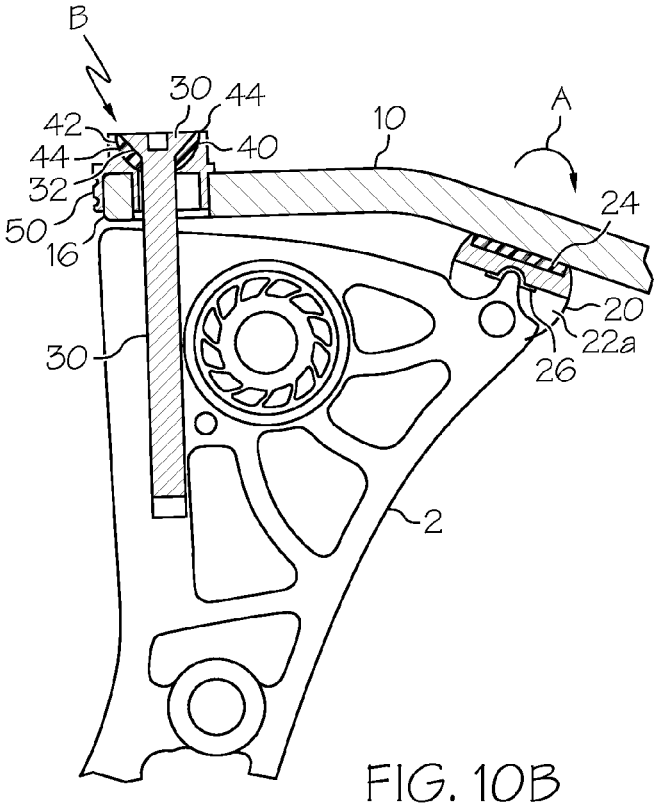

As shown in FIGS. 6 and 10, the head of the limb bolt 30 has a tapered surface 32 which is a mating fit with the upper impression 42 in the swivel washer 40. The lower surface 44 of the swivel washer 40 matches the spherical surface 52 in the top of the limb cap 50. The fit between the limb cap 50 and the bow limb 10 is best shown in FIG. 7 in which the underside of the limb cap 50 is closely fitted to the bow limb 10 such that surface 54 on the limb cap 50 is coincident with the top surface of the limb 14 and vertical surface 58 of the limb cap 50 matches the vertical surface 18 at the limb butt 18 with the vertical surface 56 of the limb cup fitting closely to the vertical surface 16 at the butt 30 of the limb 10. The result is a positive connection between the bow limb 10 and the handle 2 at the butt 30 of the bow limb 10. It should also be noted that the body surface 34 of the limb bolt 30 is a close tolerance fit with the counter bore 7 (FIG. 5) in the bow handle/riser 2.

Figure 8:
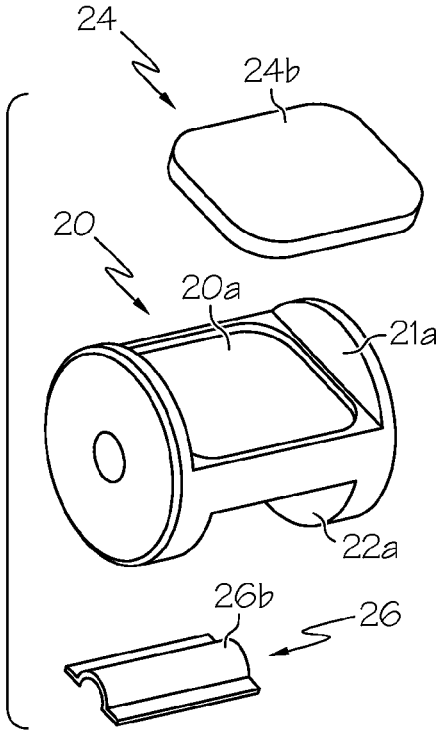
FIG. 8 is a ¾ top down view showing the various components of the limb fulcrum system.
Figure 8A:
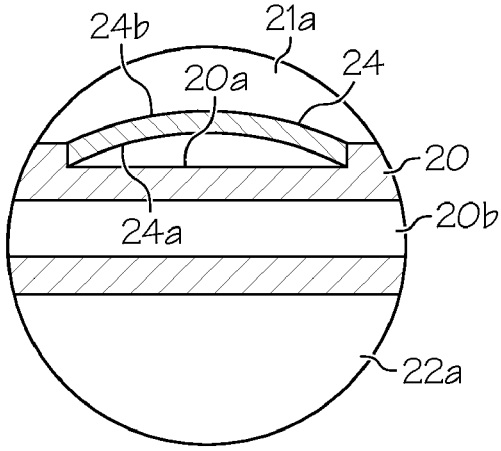
FIG. 8A is a cross-sectional view of FIG. 8 along lines 8A-8A showing the outward (i.e., convex) at-rest curve of the pad when uncompressed.
Figure 9:
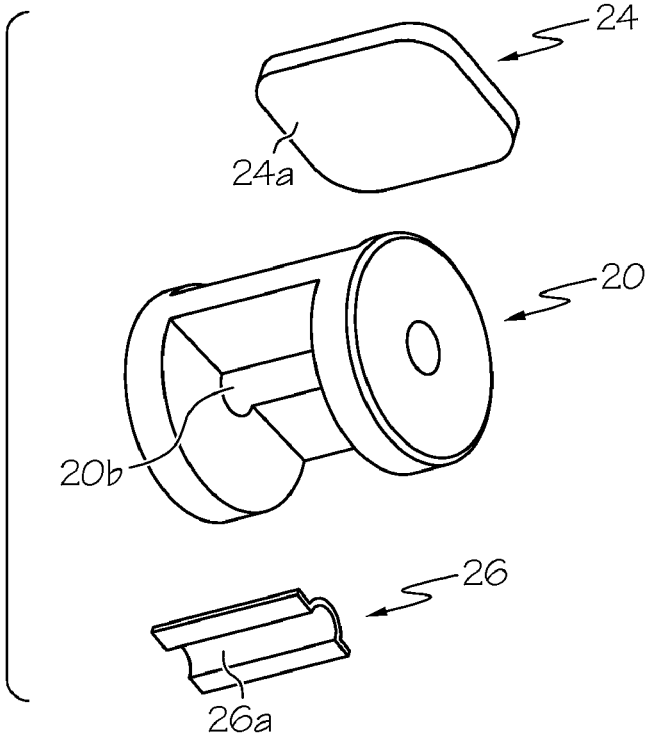
FIG. 9 is a ¾ bottom up view of the limb fulcrum and its components.

The bow limb fulcrum system of the bow limb mounting system of the present invention provides a limb connection to the handle/riser 2 thru a limb fulcrum 20. As best seen in FIGS. 8-10, the various components of the bow limb fulcrum system comprise a rectangular limb pad 24 having surface 24*a* securely fitted into a matching pocket 20*a* of the fulcrum 20. Bow limb surface 13 in turn rests against the upper surface 24*b* of the limb pad 24. The edges of the bow limb 12*b* are located closely with the inside of upper vertical surfaces 21*a* of the fulcrum 20 which prevents any lateral movement of the bow limb 10 with respect to the fulcrum 20. As shown in FIG. 8*a*, limb pad 24 is preferably manufactured to be slightly bowed outwardly (convex-shaped) when in its relaxed state such that when under compression by the bow limb 10 after assembly, it lies flat in the pocket 20*a* (see FIG. 8).

The limb fulcrum 20 is also fitted with a pivot plate 26 with the upper surface of the pivot 26*b* a mating fit with the pivot surface 20*b* of the limb fulcrum 20. The lower surface of the pivot plate at 26*a* is fitted to the upper surface 6 of handle/riser 2 and the inside edge surfaces 22*a* of the fulcrum 20 are mated to the sides of the bow handle/riser 2 at surface 8 on either side of the handle/riser 2. This arrangement allows the bow limb 10 to pivot in the plane of the bow string 80*a* while maintaining the lateral position of the bow 10 to insure that it also stays in plane.

As shown in 10B, as the bow 1 is drawn, the middle portion of the bow limb 10 tends to bow outwardly pivoting forwardly (clockwise in FIG. 10B) on the fulcrum 20 as shown by arrow A and pivoting rearwardly (counter-clockwise in FIG. 10B) on the limb cap 50 as shown by arrow B (by virtue of the swivel washer 40 spherically floating between the tapered surface 32 of the bolt head and the cap 50), thereby significantly reducing the stresses that would otherwise be imparted to the bow limb 10.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

The invention claimed is:

1. An archery bow comprising:

a riser;

a limb comprising an aperture, the aperture defined by a sidewall having an arcuate portion;

a limb bolt attaching a butt end of said limb to said riser; and a limb cap positioned between said limb bolt and said limb, said limb cap comprising a flange that extends into said aperture, wherein said flange comprises an arcuate shape that abuts the arcuate portion of the limb.

2. The archery bow of claim 1, wherein said limb sidewall further comprises a second arcuate portion and said limb cap further comprises a second arcuate shape that abuts the second arcuate portion of the limb.

3. The archery bow of claim 1, wherein said flange forms a closed perimeter that surrounds said limb bolt.

4. The archery bow of claim 1, wherein said flange contacts an internal sidewall of said limb.

5. The archery bow of claim 1, wherein said flange comprises a first flange, said limb cap further comprising a second flange arranged to abut an external sidewall of said limb.

6. The archery bow of claim 5, wherein said first flange comprises a curved portion and said second flange comprises a curved portion.

7. The archery bow of claim 6, wherein the curved portion of the first flange and the curved portion of the second flange have a common center of rotation.

8. The archery bow of claim 6, wherein at least one of said curved portions is semi-circular.

9. The archery bow of claim 6, further comprising a fulcrum member positioned between said limb and said riser, said fulcrum member offset from said limb bolt along a length of said limb.

10. The archery bow of claim 9, wherein the fulcrum comprises a first pair of sidewalls arranged to abut the riser.

11. The archery bow of claim 10, wherein the fulcrum further comprises a second pair of sidewalls arranged to abut the limb.

12. The archery bow of claim 11, wherein a spacing between the first pair of sidewalls is different from a spacing between the second pair of sidewalls.

13. The archery bow of claim 1, said limb cap further comprising a spheroidal surface.

14. The archery bow of claim 13, further comprising a washer positioned between said limb cap and said limb bolt, said washer comprising a spheroidal surface.

15. The archery bow of claim 1, wherein a curved washer is positioned between a recess in said limb cap and an underside of a head of the limb bolt.

16. An archery bow comprising:

a riser;

a limb;

a limb bolt attaching a butt end of said limb to said riser; and a limb cap positioned between said limb bolt and said limb, said limb cap comprising a flange that abuts a sidewall of said limb, the flange comprising an arcuate shape.

17. The archery bow of claim 16, said limb cap comprising a spheroidal shape.

18. The archery bow of claim 16, further comprising a fulcrum member positioned between said limb and said riser, said fulcrum member offset from said limb bolt along a length of said limb, said fulcrum member comprising a first pair of sidewalls arranged to abut the riser.

19. The archery bow of claim 18, wherein the fulcrum member further comprises a second pair of sidewalls arranged to abut the limb.

20. The archery bow of claim 19,wherein a spacing between the first pair of sidewalls is different from a spacing between the second pair of sidewalls.

21. The archery bow of claim 16, wherein said limb cap further comprises an inner flange extending into an aperture of said limb.

* * * * *